US006243978B1

(12) United States Patent
Vignaroli et al.

(10) Patent No.: US 6,243,978 B1
(45) Date of Patent: Jun. 12, 2001

(54) DEVICE FOR CONTROLLING THE FEEDER SYSTEM OF PUMP-ACTION SHOTGUNS

(75) Inventors: Marco Vignaroli, Perugia; Sergio Scaramucci, Gallo di Petriano, both of (IT)

(73) Assignee: Benelli Armi S.p.A., Urbino (IT)

( * ) Notice: Subject to any disclaimer, the term of this patent is extended or adjusted under 35 U.S.C. 154(b) by 0 days.

(21) Appl. No.: 09/289,844

(22) Filed: Apr. 12, 1999

(30) Foreign Application Priority Data

Apr. 29, 1998 (IT) ..... MI98A0913

(51) Int. Cl.[7] ..... F41A 3/00; F41A 3/58; F41A 17/42; F41A 9/00

(52) U.S. Cl. ..... 42/17; 42/39.5; 42/70.02; 89/33.03

(58) Field of Search ..... 42/17, 21, 15, 42/20, 39.5, 27, 70.01, 43, 70.02; 89/33.03, 33.01

(56) References Cited

U.S. PATENT DOCUMENTS 2,586,509 * 2/1952 Browning ..... 42/17
2,596,841 * 5/1952 Davidson ..... 42/17
3,142,921 * 8/1964 Ruger ..... 42/17
3,919,800 * 11/1975 Browning ..... 42/17
4,601,122 * 7/1986 Beretta ..... 42/21
4,856,217 * 8/1989 Benelli ..... 42/17

FOREIGN PATENT DOCUMENTS

567011 * 12/1958 (CA) ..... 42/17
591670 * 12/1973 (CH) ..... 42/17

* cited by examiner

*Primary Examiner*—Peter M. Poon
*Assistant Examiner*—Son T. Nguyen
(74) *Attorney, Agent, or Firm*—R. Neil Sudol; Henry D. Coleman; William J. Sapone

(57) ABSTRACT

A device for controlling the feeder system of pump-action shotguns having a breech-block which is operatively associated, by virtue of two braces, with a cocking rod (3) moving between two stroke limit positions of the breech-block, a closed position and an open position. The rod motion actuates the feeding of a cartridge from a tubular magazine (5) to a rising block when the breech-block reaches the open position and from the rising block into the firing chamber of the barrel (7) when the breech-block returns to the closed position. The device includes a limiter (9) for limiting the opening stroke of the breech-block and for selectively preventing the breech-block from reaching the open stroke limit position.

13 Claims, 22 Drawing Sheets

DEVICE FOR CONTROLLING THE FEEDER SYSTEM OF PUMP-ACTION SHOTGUNS

BACKGROUND OF THE INVENTION

1. Field of the Invention

The present invention relates to a device for controlling the feeder system of pump-action shotguns.

2. Description of the Prior Art

In so-called pump-action guns, the breech-block closure system is actuated by means of one or two braces which are parallel to the axis of the barrel and are actuated by a manual pump-action cocking rod.

By acting on the cocking rod, the breech-block is disengaged from the breech to retract it into the position for opening the firearm; the same movement also actuates the lever (or levers) for retaining the cartridge in the tubular magazine located below the barrel coaxially to the cocking rod. The breech-block, during the first step of its return to the closure position, also actuates the rising block, in a conventional manner, to allow to insert the cartridge that has left the magazine into the barrel.

Accordingly, in order to achieve the transfer of the cartridge from the magazine to the firing chamber of the barrel, the retrograde opening stroke of the breech-block assembly of the firearm is utilized in order to synchronize the movements of the lever (or levers) for retaining the cartridge in the magazine, for the exit of a single cartridge at a time, with the movements of the rising block, on which the cartridge that leaves the magazine arranges itself to be subsequently lifted into a position which is suitable for insertion in the barrel.

The operation of the feeder system of conventional pump-action shotguns is reliable and substantially perfect, but it has some operating limitations. When one wishes to unload the firearm, removing the cartridge from the barrel, it is in fact necessary to operate the braces by means of the manual pump-action cocking rod. This necessarily causes a cartridge to move from the magazine onto the rising block. Accordingly, it is not possible to unload the cartridges from the magazine without making them fall one by one onto the rising block: in order to unload the firearm it is therefore necessary to act on the pump repeatedly as many times as there are cartridges in the magazine.

It is also not possible to fire without using the cartridges that are present in the magazine. This limitation is evident when it is necessary, in particular situations, to use a cartridge of a different type than the cartridges that are present in the magazine.

The aim of the present invention is to obviate the above mentioned drawbacks of conventional pump-action shotguns.

An object of the invention is to provide a device for controlling the pump-action mechanism of a firearm which allows to unload the firearm by removing the cartridge in the barrel without making a new cartridge fall onto the rising block from the magazine.

A further object of the invention is to provide a device which allows to fire a series of shots without using the cartridges in the magazine but by manually inserting the cartridge in the barrel for each shot.

A further object of the invention is to provide a device which has a simple construction and is reliable in use.

SUMMARY OF THE INVENTION

This aim, these objects and others which will become apparent hereinafter are achieved by a device for controlling the feeder system of pump-action shotguns, comprising a breech-block which is operatively associated with a cocking rod which is suitable to move between two stroke limit positions of the breech-block, a closed position and an open position, the rod motion actuating the feeding of a cartridge from a tubular magazine to a rising block when the breech-block reaches the open position and from the rising block into the firing chamber of the barrel when the breech-block returns to the closed position, characterized in that it comprises a limiter for limiting the retrograde stroke of the cocking rod, for the opening of the breech-block, for selectively preventing the breech-block from reaching the open stroke limit position.

Further characteristics and advantages will become apparent from the description of a preferred but not exclusive embodiment of the invention, illustrated only by way of non-limitative example in the accompanying drawings.

DESCRIPTION OF THE PREFERRED EMBODIMENTS OF THE INVENTION

Figure 1:
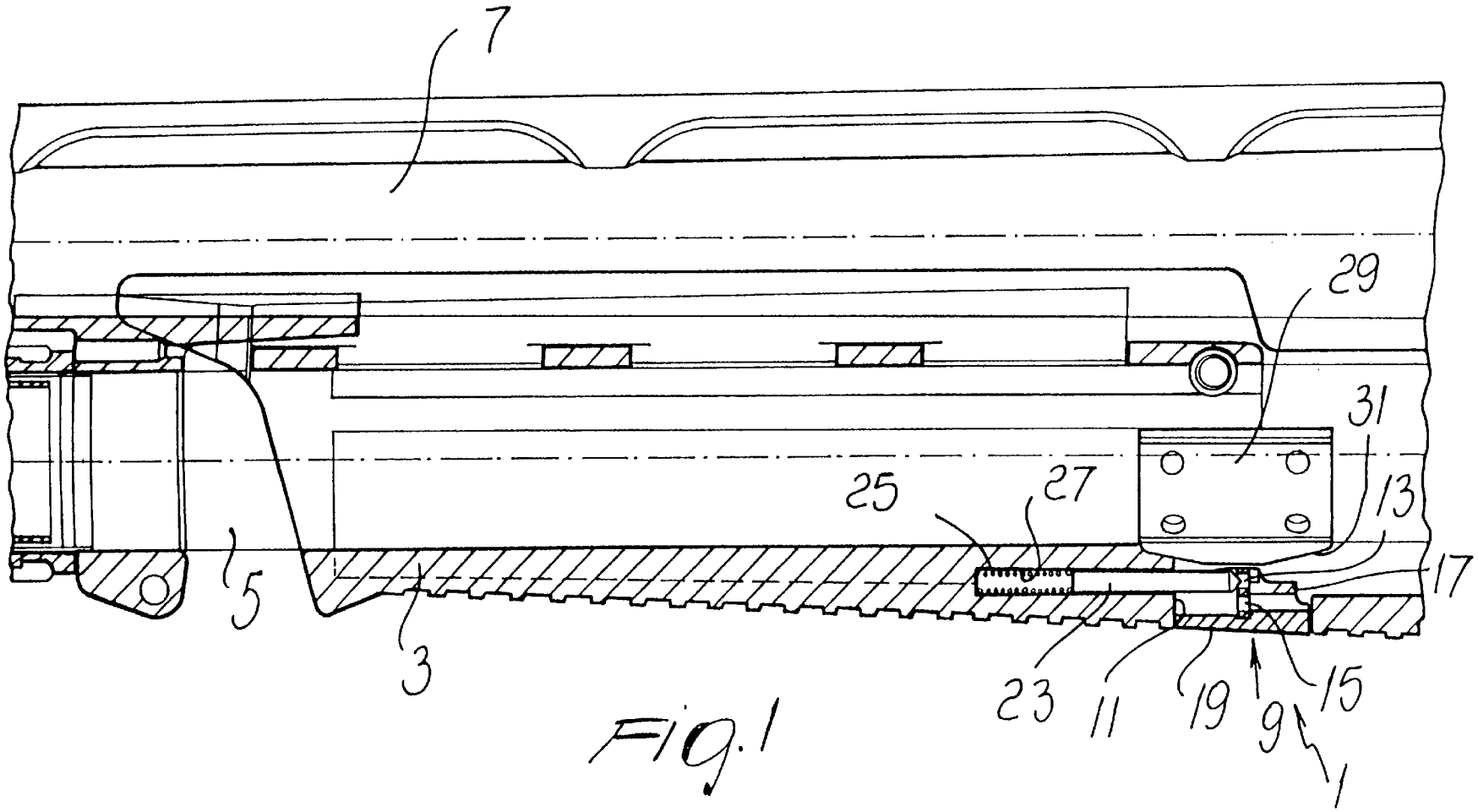
FIG. 1 is a partial sectional view, taken along a longitudinal plane, of a pump-action shotgun provided with the device according to the invention, shown in the closed position of the breech-block.

With particular reference to FIGS. 1 to 7, the device for controlling the feeding system of pump-action shotguns, according to the invention, generally designated by the reference numeral 1, can be applied to a pump-action shotgun of the conventional type, which includes a cocking rod 3 sliding coaxially to a cartridge magazine 5, which is in turn arranged below the barrel 7. The cocking rod 3 actuates one or two braces (not shown) which are associated with the breech-block (not shown in the drawings) in a per se known manner.

The control device includes a limiter 9 adapted to slide in a seat 11 which is formed in the cocking rod 3 and runs substantially at right angles to the longitudinal direction of the movement of the cocking rod. The limiter 9 includes a button 19 which can be operated with one finger of the hand that grips the cocking rod 3, on which there are two locking seats 13 and 15 and a locking tooth 17 adapted to cooperate with a fixed abutment 21 which is constituted, for example, by the front plane of the frame.

The seats 13 and 15 can be engaged alternately by a pin or pivot 23 which can slide, in contrast with a spring 25, in a seat 27 which is perpendicular to the seat 11. By engaging the seat 13 or 15 respectively, the pin 23 keeps the limiter 9 respectively in a position for the normal operation of the firearm or in a position for limiting the retrograde stroke of the cocking rod 3.

The control device includes a means for restoring the normal operating position of the limiter 9. The restoring means is constituted by two contoured blades which are mounted to the tubular magazine 5 in such a position as to interfere with the limiter 9 when the cocking rod 3 is substantially in the position that corresponds to the breech-block closure position.

Each blade 29 includes at least one inclined plane 31 adapted to cooperate with an inclined plane 33 formed on the limiter 9.

Figure 2:
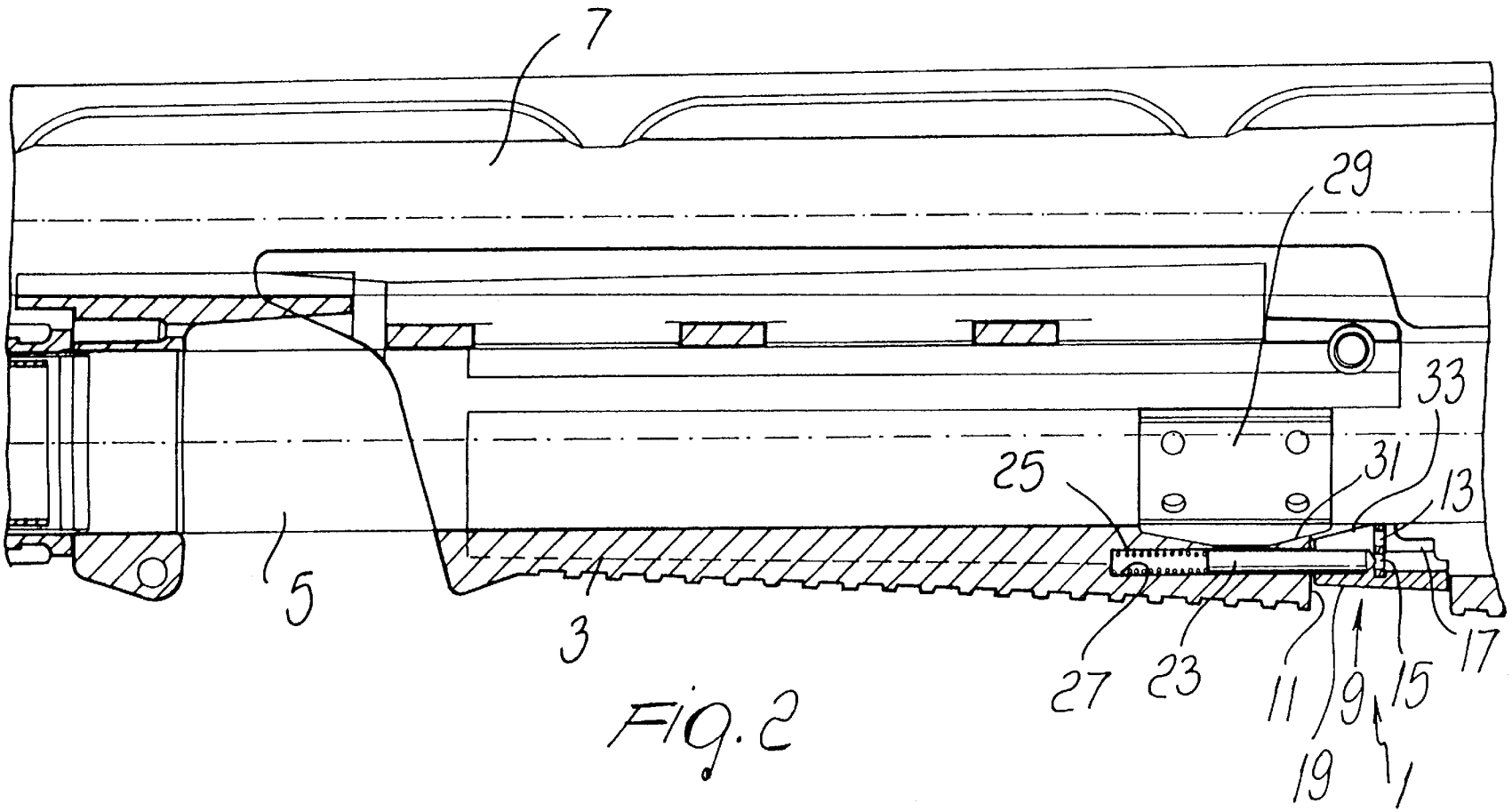
FIG. 2 is a view, similar to FIG. 1, of the cocking rod in a partially retracted position and of the device in the stroke limiting position.
Figure 3:
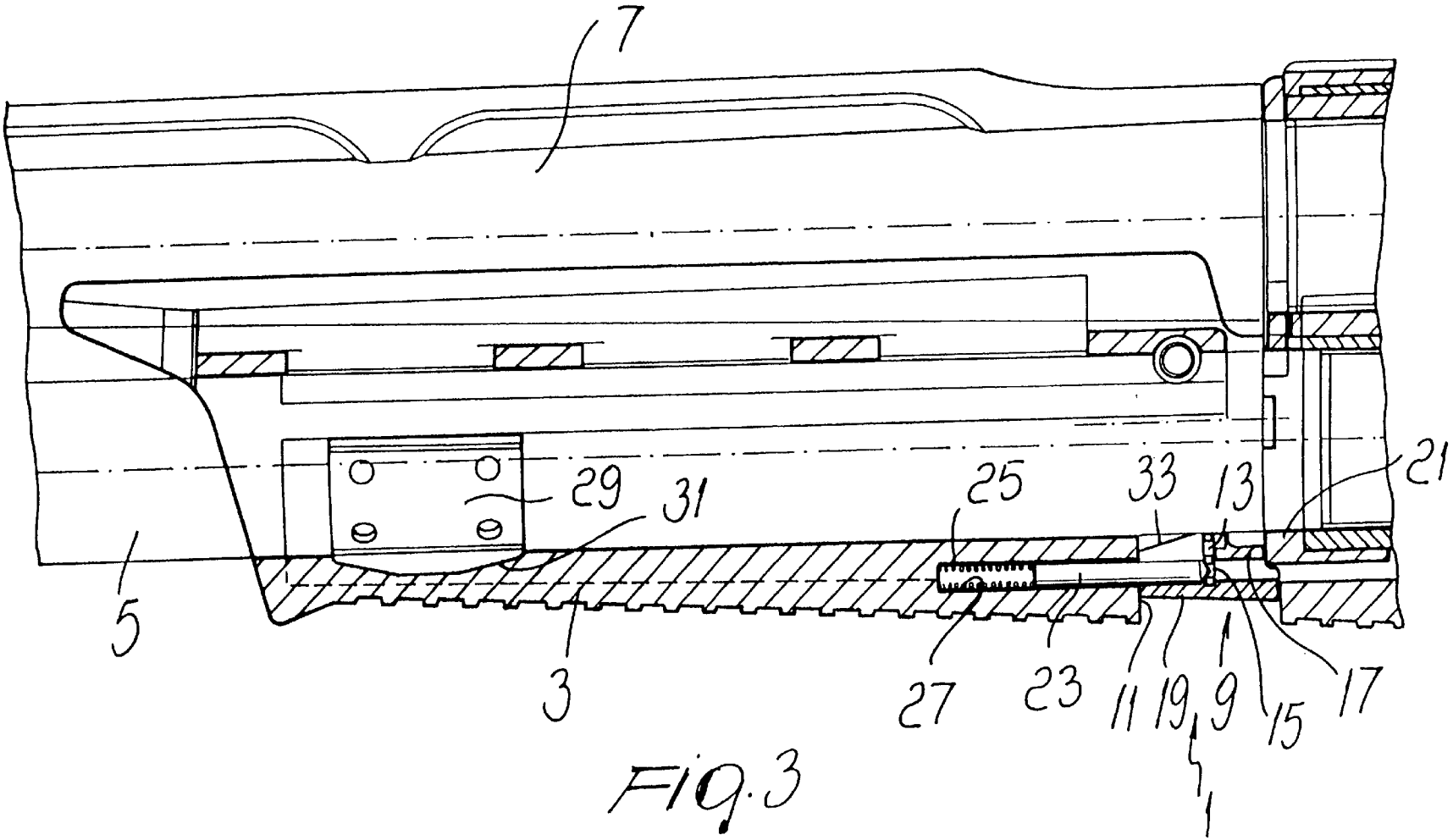
FIG. 3 is a view, similar to FIG. 2, of the cocking rod in the rearmost position with the device in the stroke limiting position.

The operation of the device according to the invention is as follows. In FIG. 1, the cocking rod 3 of the shotgun is shown in the initial position, from which it is made to slide backward (to the right in the drawings) by the user, who holds it with one hand. If the user wishes to operate the device according to the invention, he or she merely has to press the button 19 with one finger of the same hand that holds the cocking rod, at the same time pulling the cocking rod, as shown in FIG. 2. The limiter 9 is accordingly set to the stroke limiting position, so that when the limiter 9 reaches the fixed abutment 21 constituted by the front surface of the frame the cocking rod 3 cannot move beyond the preset position and complete its normal stroke. The position of the fixed abutment (front surface of the frame) is such that the stroke of the cocking rod is interrupted before the lever for retaining the cartridge in the magazine is operated. At this point the user is free to perform operations such as unloading the cartridge that is present in the barrel and the insertion of a new cartridge in the firing chamber without having to use the cartridges already contained in the magazine.

Figure 4:
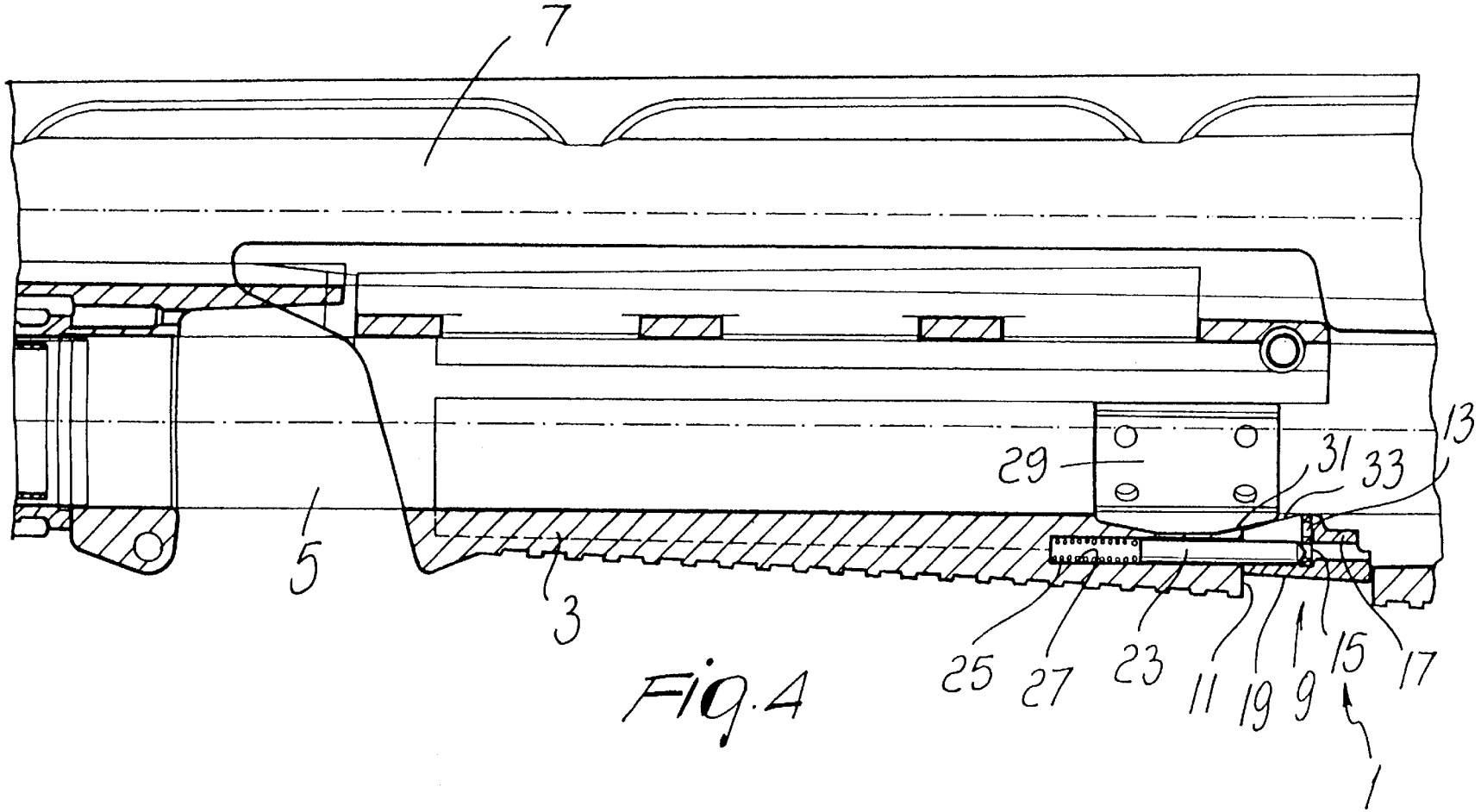
FIG. 4 is a view, similar to FIG. 3, of the cocking rod in the return stroke.
Figure 5:
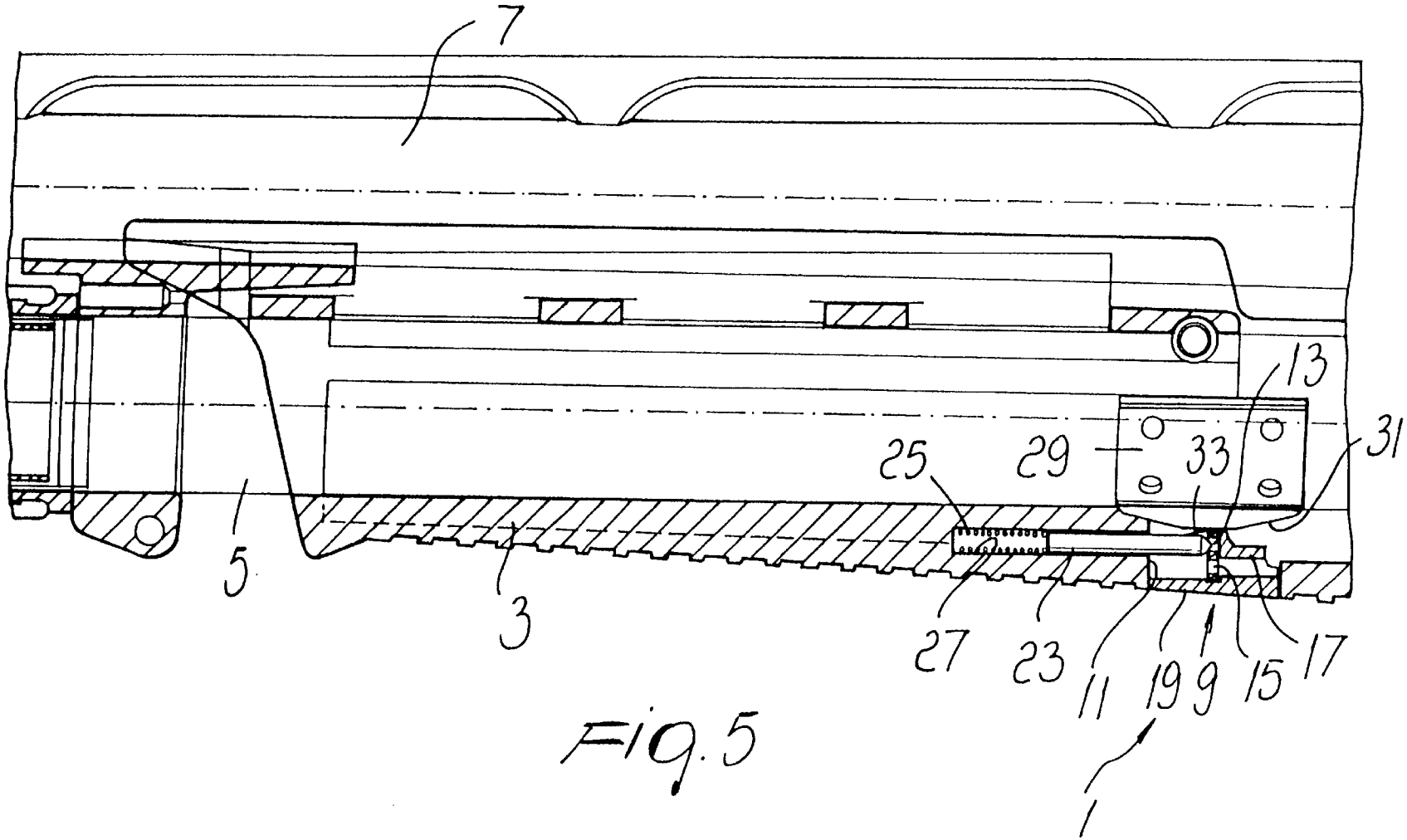
FIG. 5 is a view, similar to FIG. 4, of the cocking rod in the position that corresponds to the closure of the breech-block.

When the user returns the cocking rod to the initial position, the limiter 9 returns to its normal operating position by virtue of the action of the restoring means 29, as shown in FIG. 4. When the cocking rod 3 slides forward, the inclined plane 33 of the limiter 9 acts in contrast with the inclined plane 31 of the restoring means 29, forcing the limiter 9 to slide outward within its seat (FIGS. 4 and 5).

Figure 6:
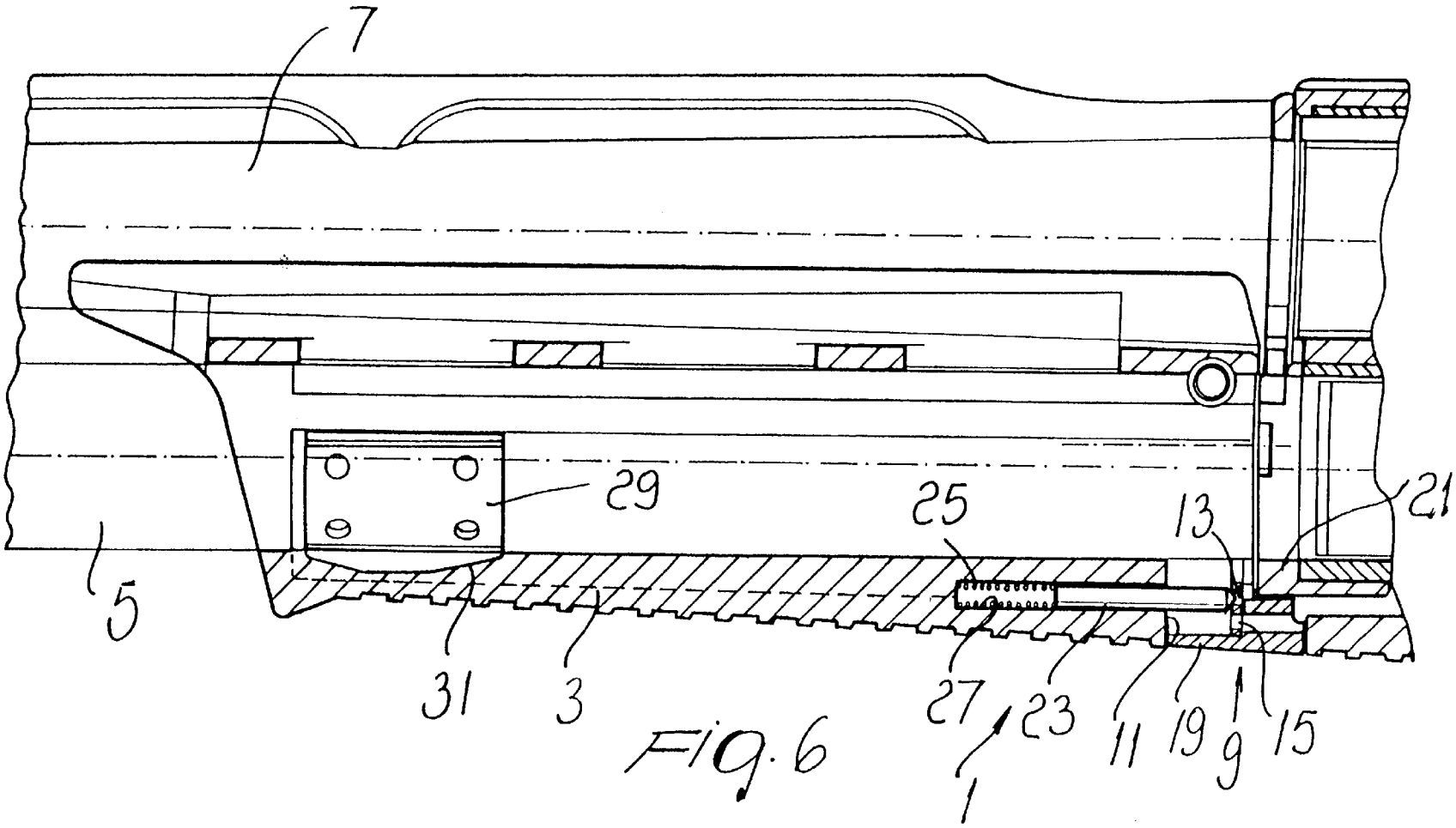
FIG. 6 is a view, similar to FIG. 5, of the cocking rod in the fully retracted position, in the breech-block opening position with the device in the position for the normal operation of the firearm.
Figure 7:
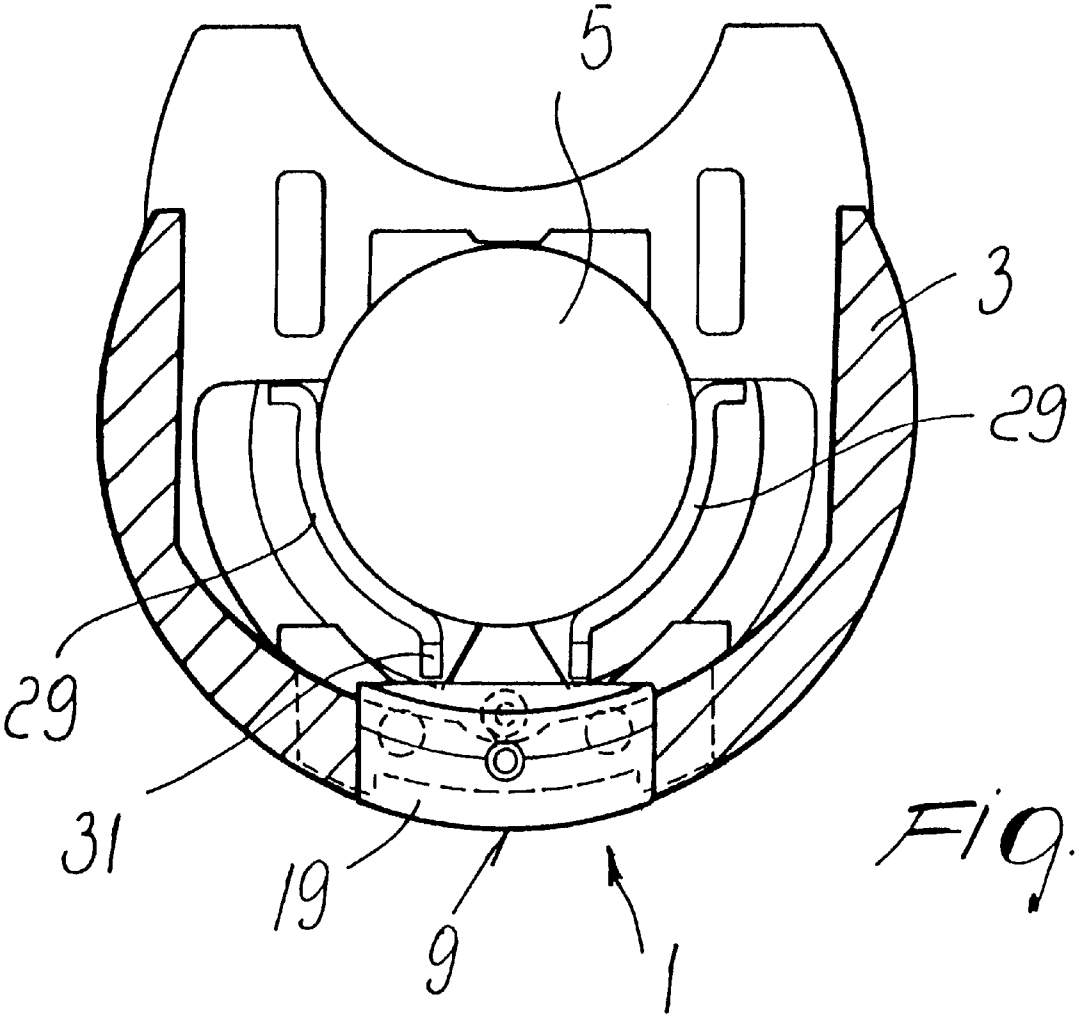
FIG. 7 is a partial sectional view, taken along a transverse plane, of the shotgun provided with the device according to the invention.

The limiter 9 is stably retained in its normal operating position by virtue of the action of the pin 23 in the seat 15, and if the user does not press the button 19 during the retrograde movement of the cocking rod, the shotgun operates normally, since the cocking rod is free to perform its intended stroke in full, as shown in FIG. 6, since the limiter 9 does not interfere with the fixed abutment 21 constituted by the front surface of the frame.

From the above description it is apparent that the device for controlling the feeder system cannot be engaged when the firearm is in the closure position (FIG. 1) but can be engaged only when the backwards motion of the cocking rod (FIG. 2) has begun in order to unload the firearm.

In practice it has been found that the invention achieves the intended aim and objects.

The device according to the invention is susceptible of numerous modifications and variations, within the scope of the appended claims. All the details may be replaced with technically equivalent elements.

Figure 8:
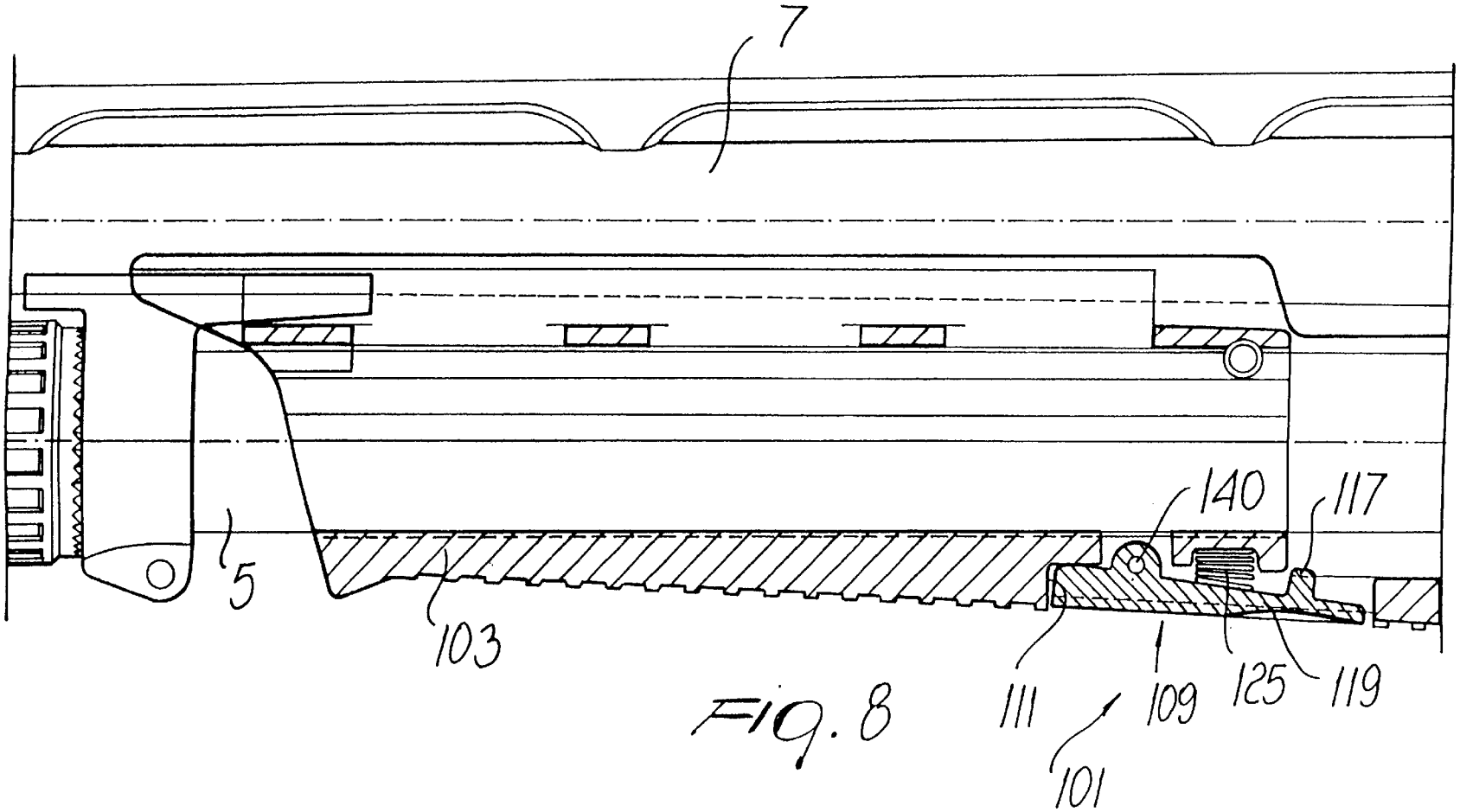
FIG. 8 is a partial sectional view, taken along a longitudinal plane, of a pump-action shotgun provided with the device according to a further aspect of the invention, shown in the breech-block closure position.
Figure 9:
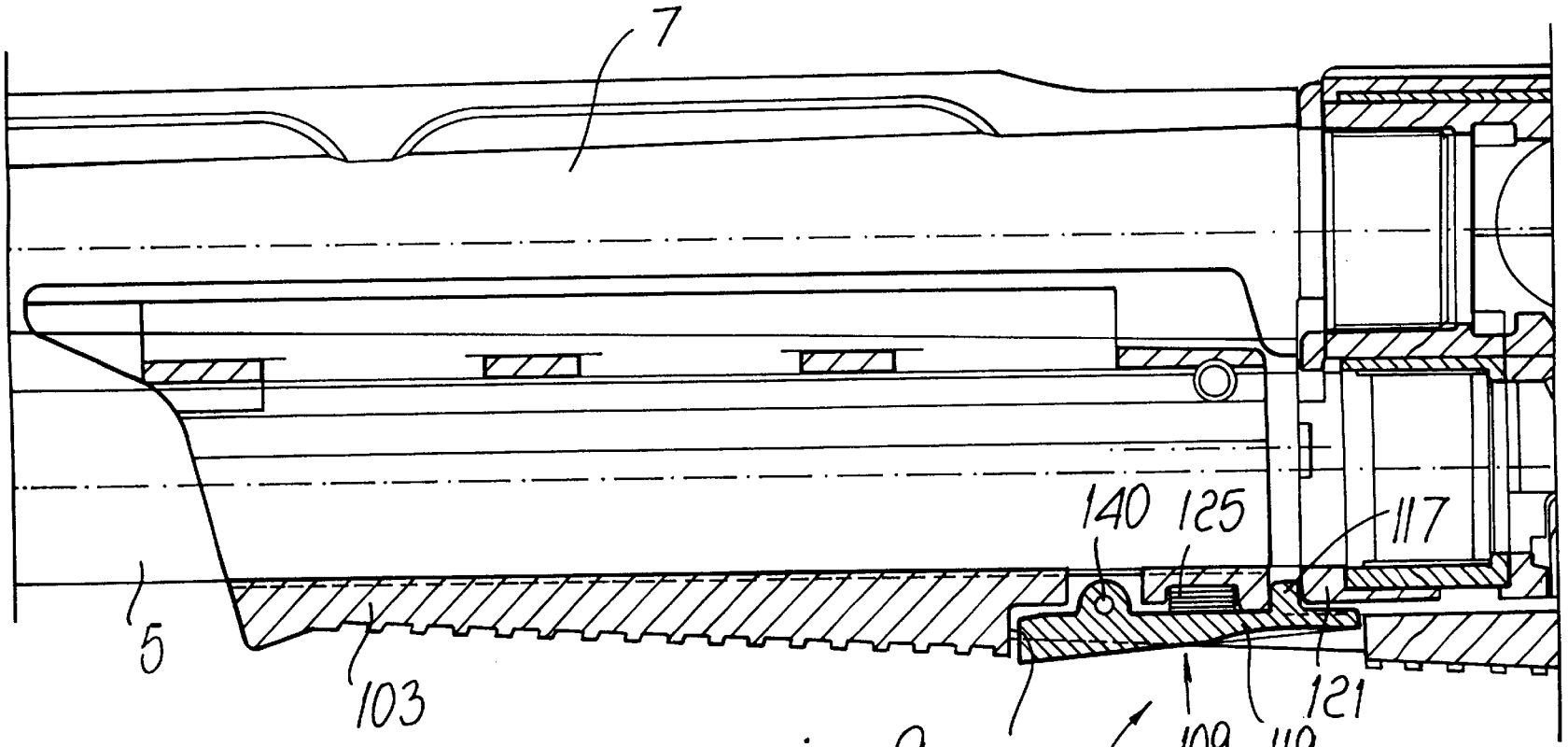
FIG. 9 is a view, similar to FIG. 8, of the cocking rod in the rearmost position, with the device in the stroke limiting position.
Figure 10:
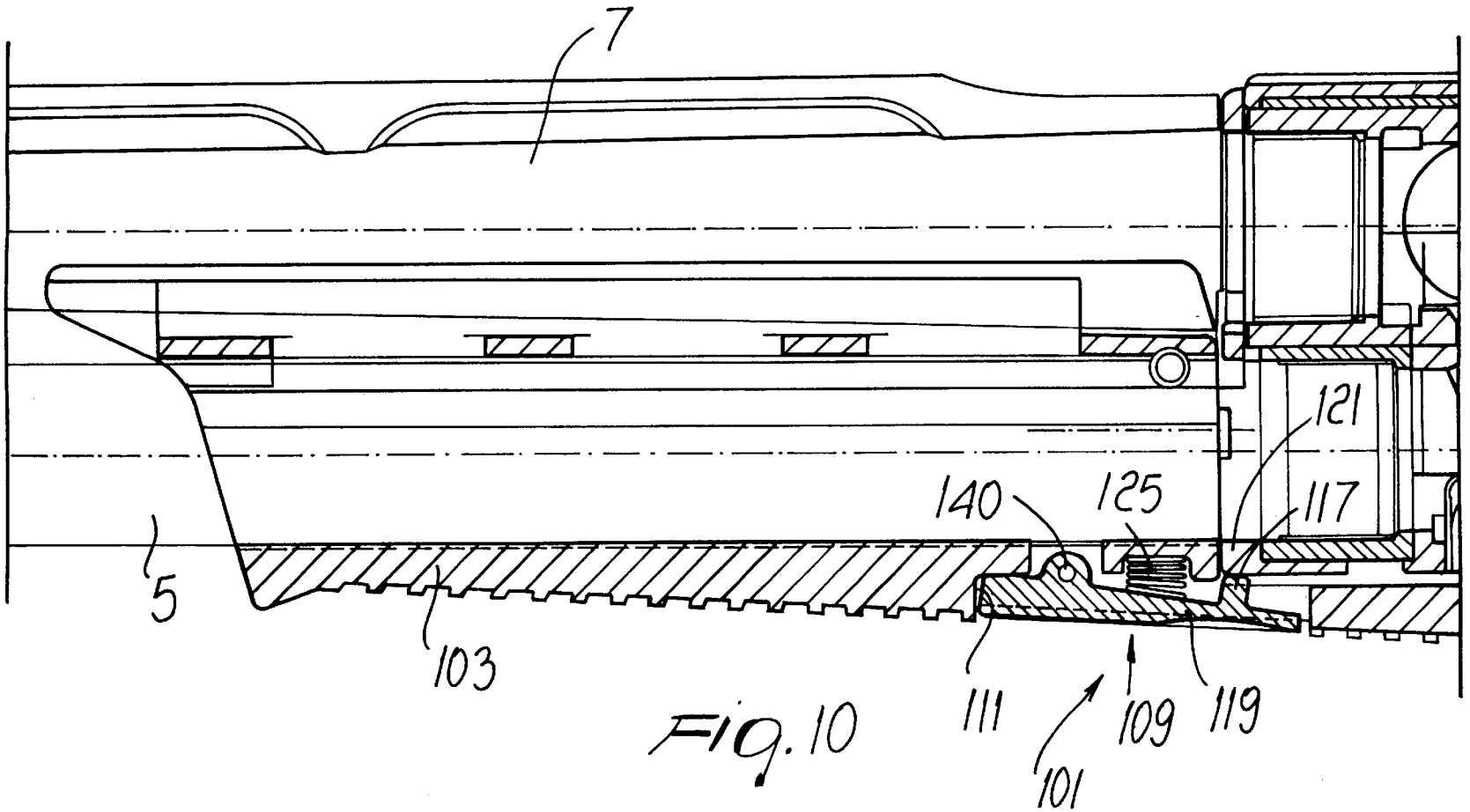
FIG. 10 is a view, similar to FIG. 9, of the cocking rod in the fully retracted position, in the breech-block opening position with the device in the position for the normal operation of the firearm.
Figure 11:
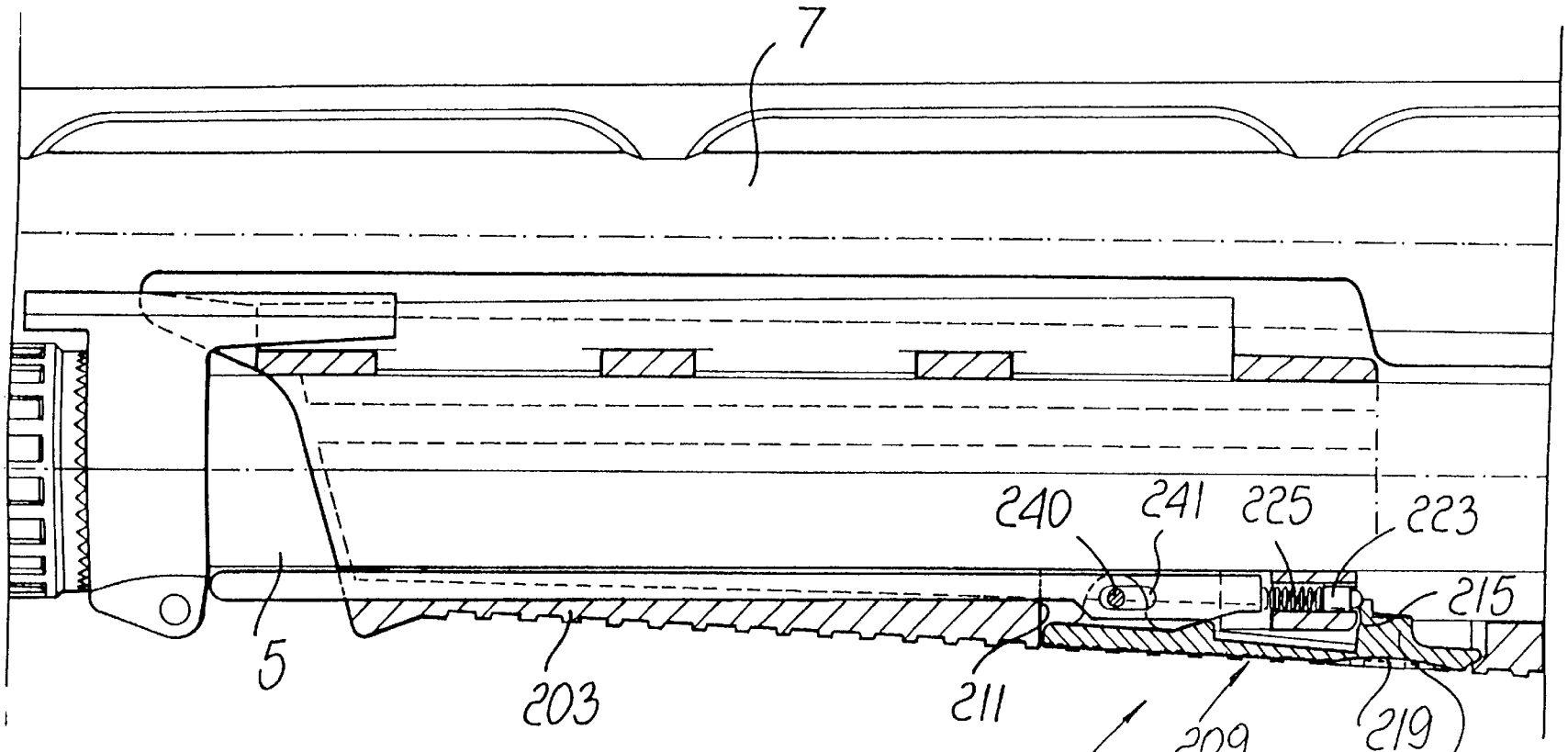
FIG. 11 is a partial sectional view, taken along a longitudinal plane, of a pump-action shotgun provided with the device according to a third aspect of the invention, shown in the breech-block closure position.
Figure 12:
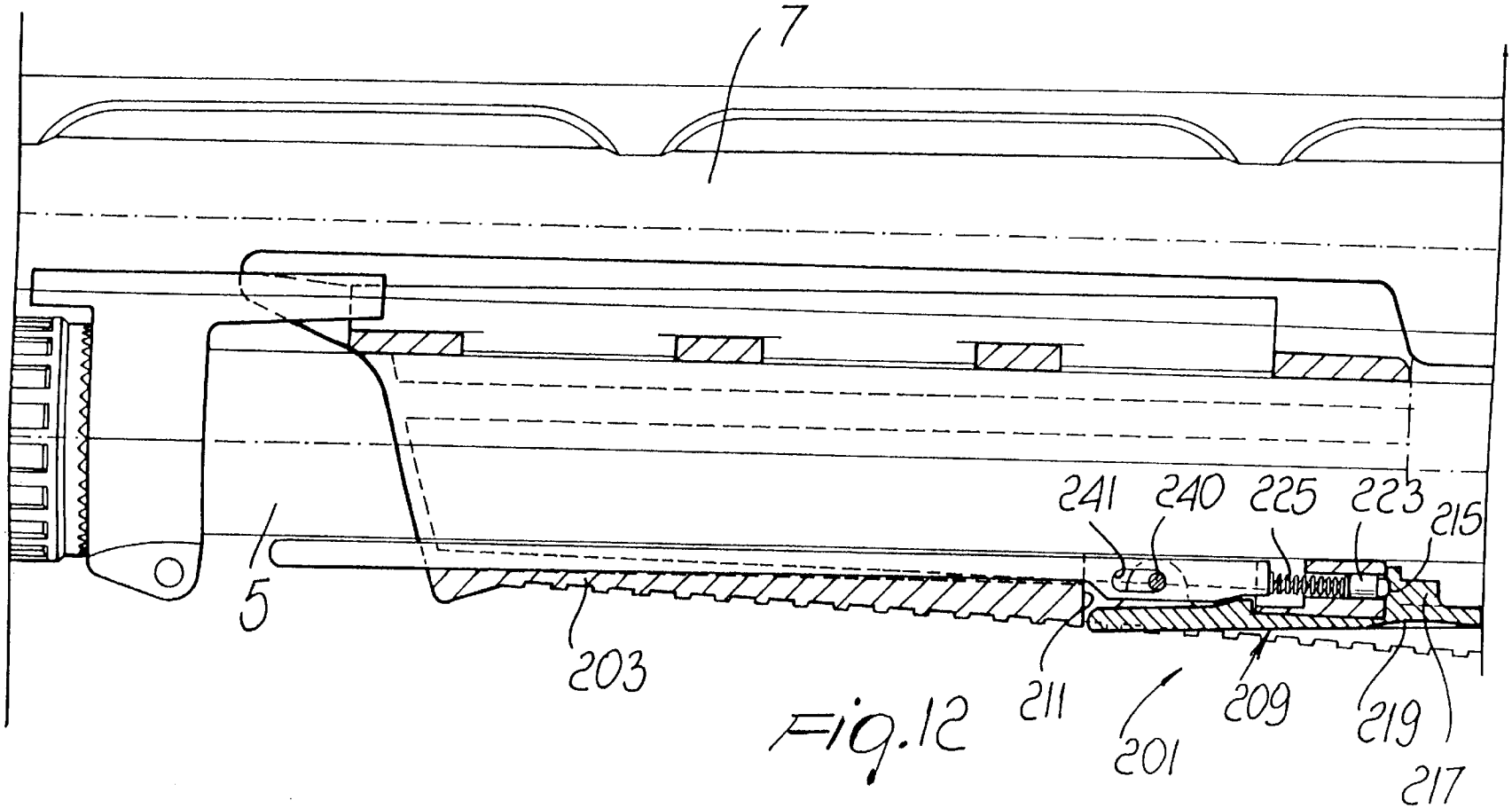
FIG. 12 is a view, similar to FIG. 11, of the cocking rod in a partially retracted position and of the device in the stroke limiting position.
Figure 13:
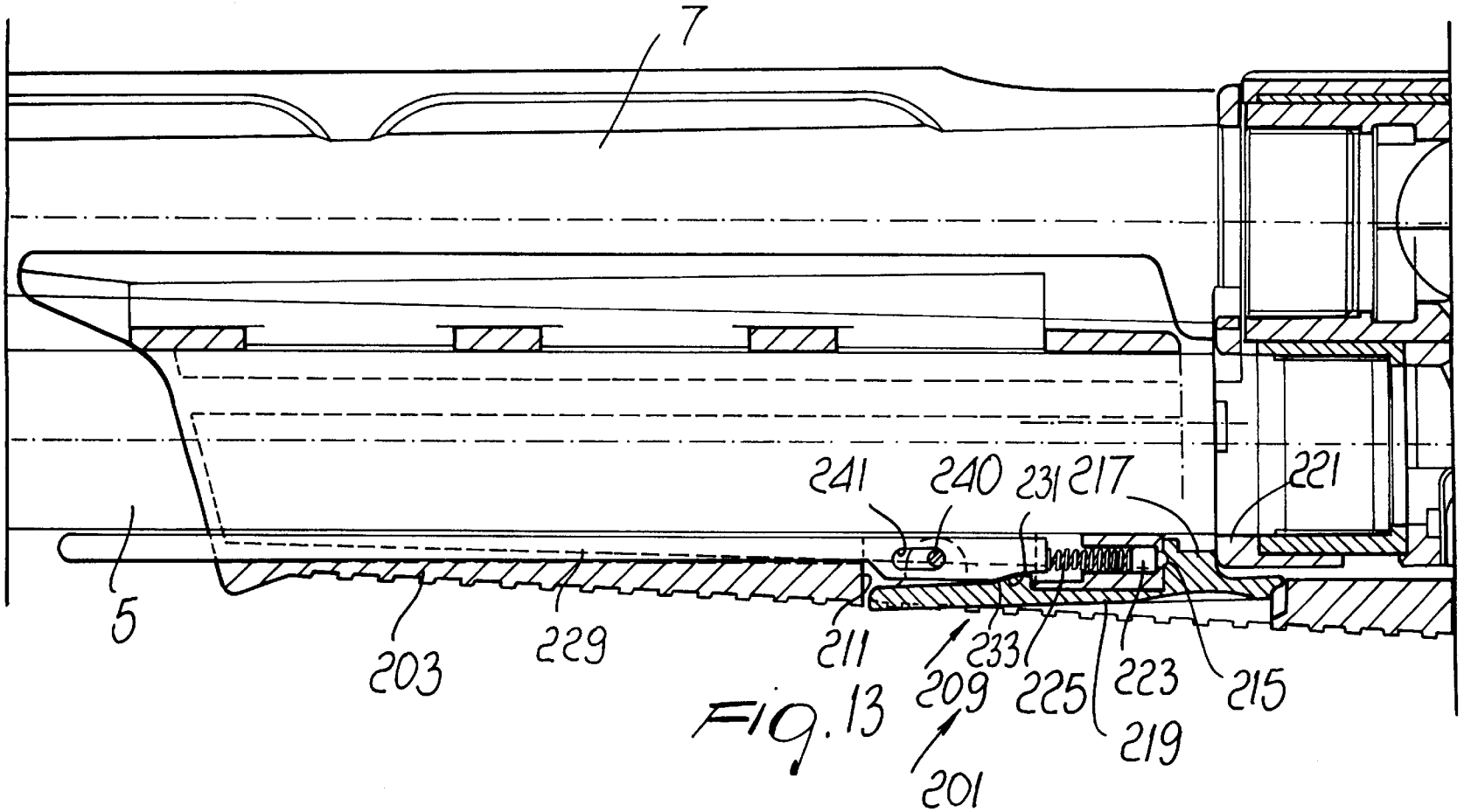
FIG. 13 is a view, similar to FIG. 12, of the cocking rod in the rearmost position, with the device in the stroke limiting position.
Figure 14:
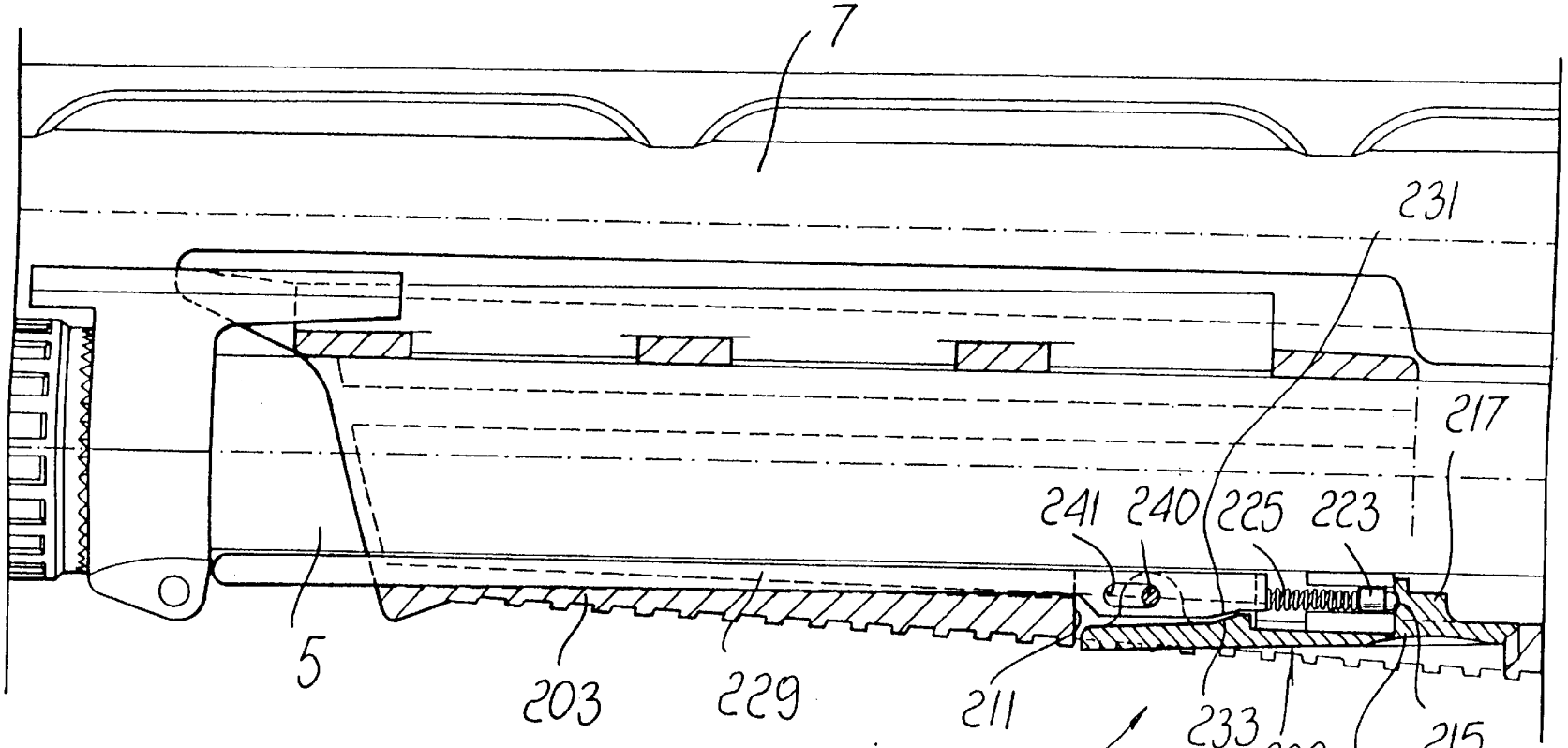
FIG. 14 is a view, similar to FIG. 13, of the cocking rod in the return stroke.

For example, according to a further aspect of the invention, FIGS. 8–10 illustrate a device for controlling the feeder system of pump-action shotguns generally designated by the reference numeral 101, which can be applied to a conventional-type pump-action shotgun which includes a cocking rod 103 which can slide coaxially on a cartridge magazine 5 which is in turn arranged below the barrel 7. The cocking rod 103 actuates one or two braces which are associated with the breech-block (the braces are not shown in the drawings) in a per se known manner.

The control device includes a limiter 109 which is arranged in a seat 111 which is formed in the cocking rod 103. The limiter 109 is constituted by a lever which is pivoted to the cocking rod 103 by means of the pivot 140 and includes a button 119 which can be operated with one finger of the hand that grips the cocking rod 103. The limiter 109 can move in contrast with a spring 125 which is adapted to keep it in a normal operating position and includes a locking member 117 which cooperates with a fixed abutment 121 constituted by the front surface of the frame.

The operation of the device is similar to the operation of the device described above. FIG. 8 shows the initial position of the cocking rod, from which it is made to slide backwards (to the right in the figures) by the user, who grips it with one hand. If the user wishes to operate the device according to the invention, he merely needs to keep the button 119 pressed with one finger of the same hand that grips the rod while he retracts the rod over its entire stroke. FIG. 9 shows the device in the stroke limiting position, so that when the limiter 109 reaches the fixed abutment 21, constituted by the front surface of the frame, the cocking rod 103 cannot move beyond the preset position and complete its normal stroke. FIG. 10 instead shows the device in the normal operating position, in which the limiter 109 does not interfere with the front surface 21 of the frame when the cocking rod is retracted.

FIGS. 11–16 illustrate a device for controlling the feeder system of pump-action shotguns according to a third aspect of the invention, generally designated by the reference numeral 201, which can be applied to a pump-action shotgun of the conventional type which includes a cocking rod 203 which can slide coaxially on a cartridge magazine 5 which is in turn arranged below the barrel 7. The cocking rod 203 actuates one or two braces which are associated with the breech-block (and are not shown in the drawings) in a per se known manner.

The control device includes a limiter 209 arranged in a seat 211 formed in the cocking rod 203. The limiter 209 is constituted by a lever which is pivoted to the rod 203 by means of the pivot 240, which is rigidly coupled to the body of the shotgun. The limiter 209 includes a button 219 which can be actuated with one finger of the hand that grips the cocking rod 203, a locking seat 215 and a locking member 217 which is suitable to cooperate with a fixed abutment 221 constituted by the front surface of the frame.

The seat 215 can be engaged by a pin or pivot 223 which can slide longitudinally in contrast with a spring 225. By engaging the seat 215, the pin 223 keeps the limiter 209 in the operating position for limiting the retrograde stroke of the cocking rod 203.

Figure 15:
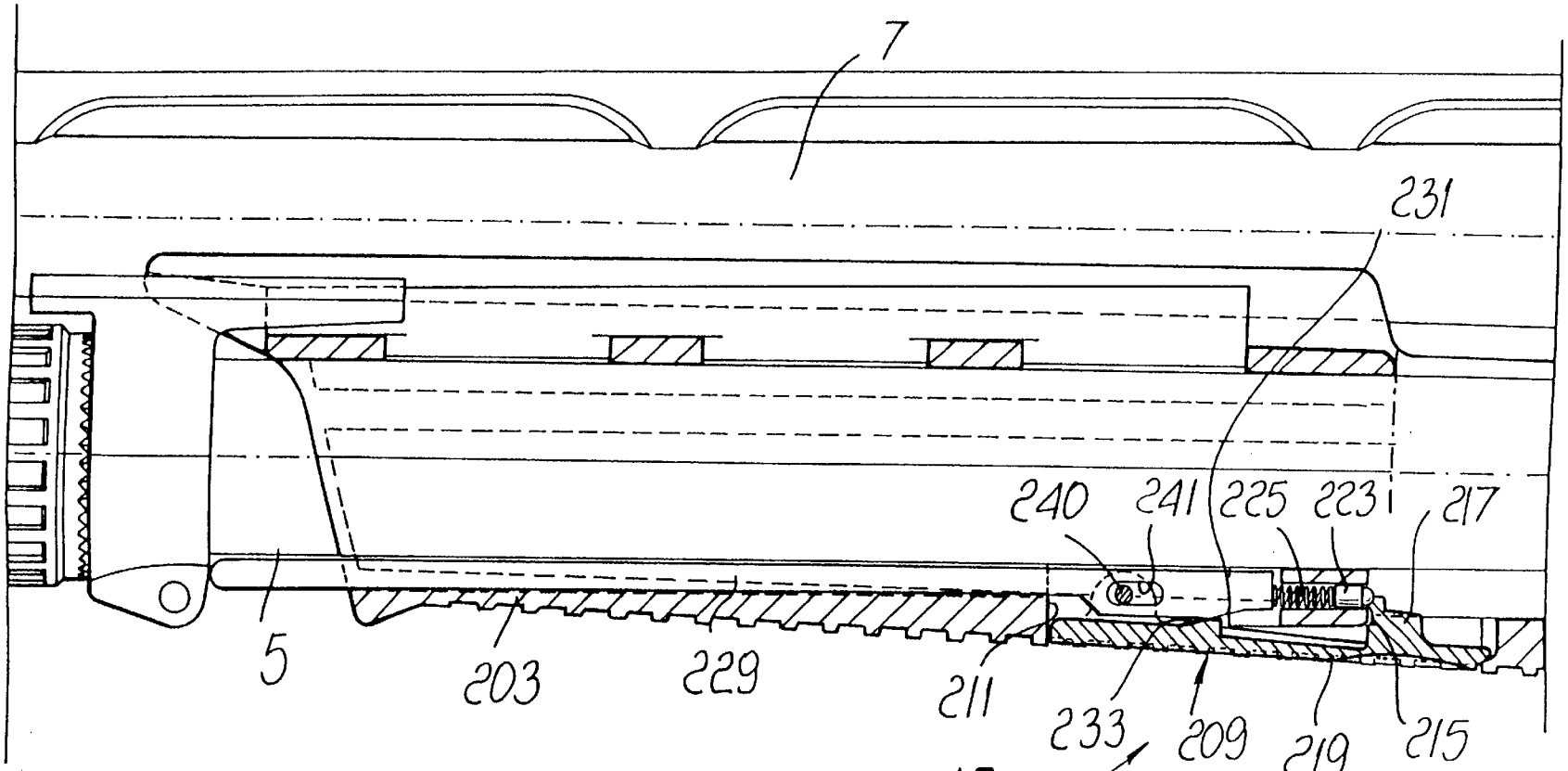
FIG. 15 is a view, similar to FIG. 14, of the cocking rod in the position that corresponds to the closure of the breech-block.
Figure 16:
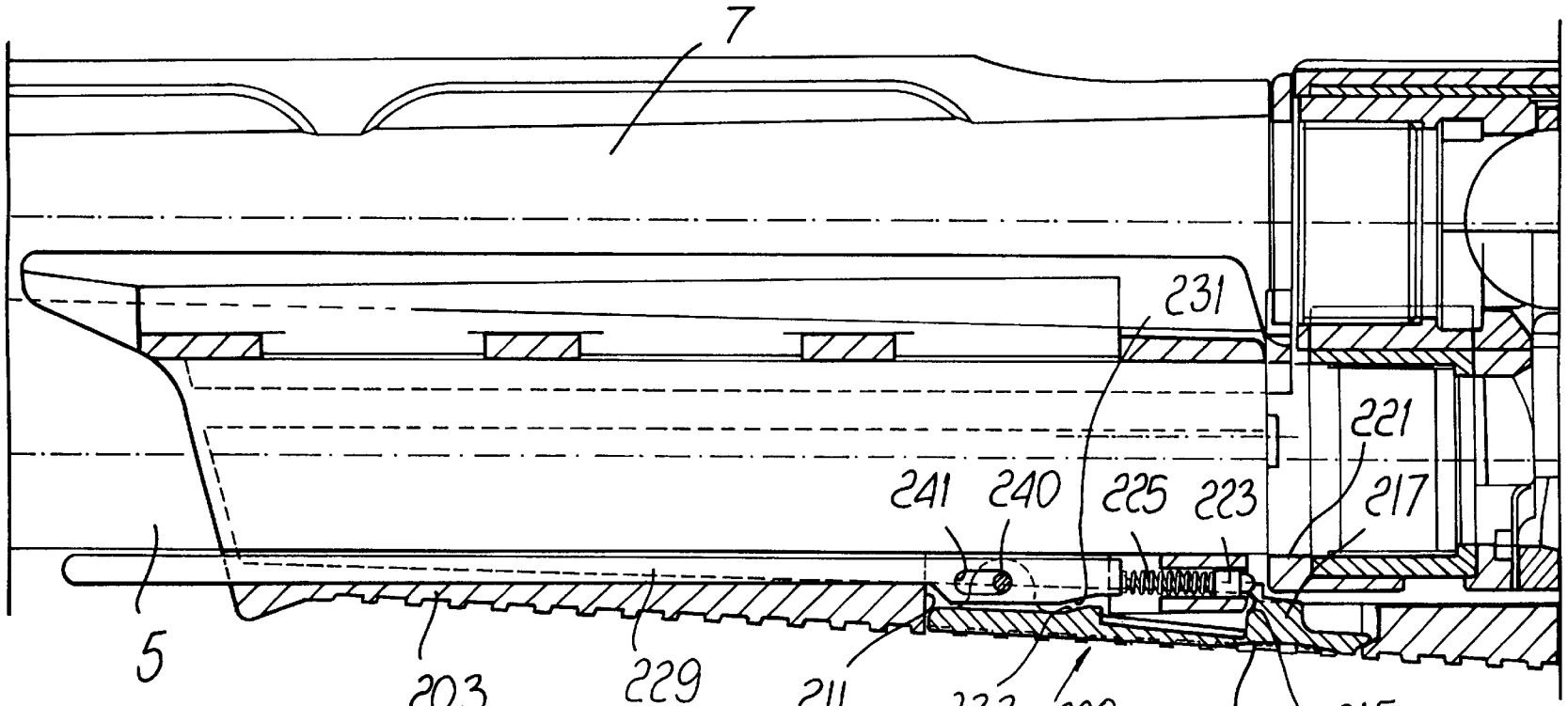
FIG. 16 is a view, similar to FIG. 15, of the cocking rod in the fully retracted position, in the breech-block opening position with the device in the position for the normal operation of the firearm.
Figure 17:
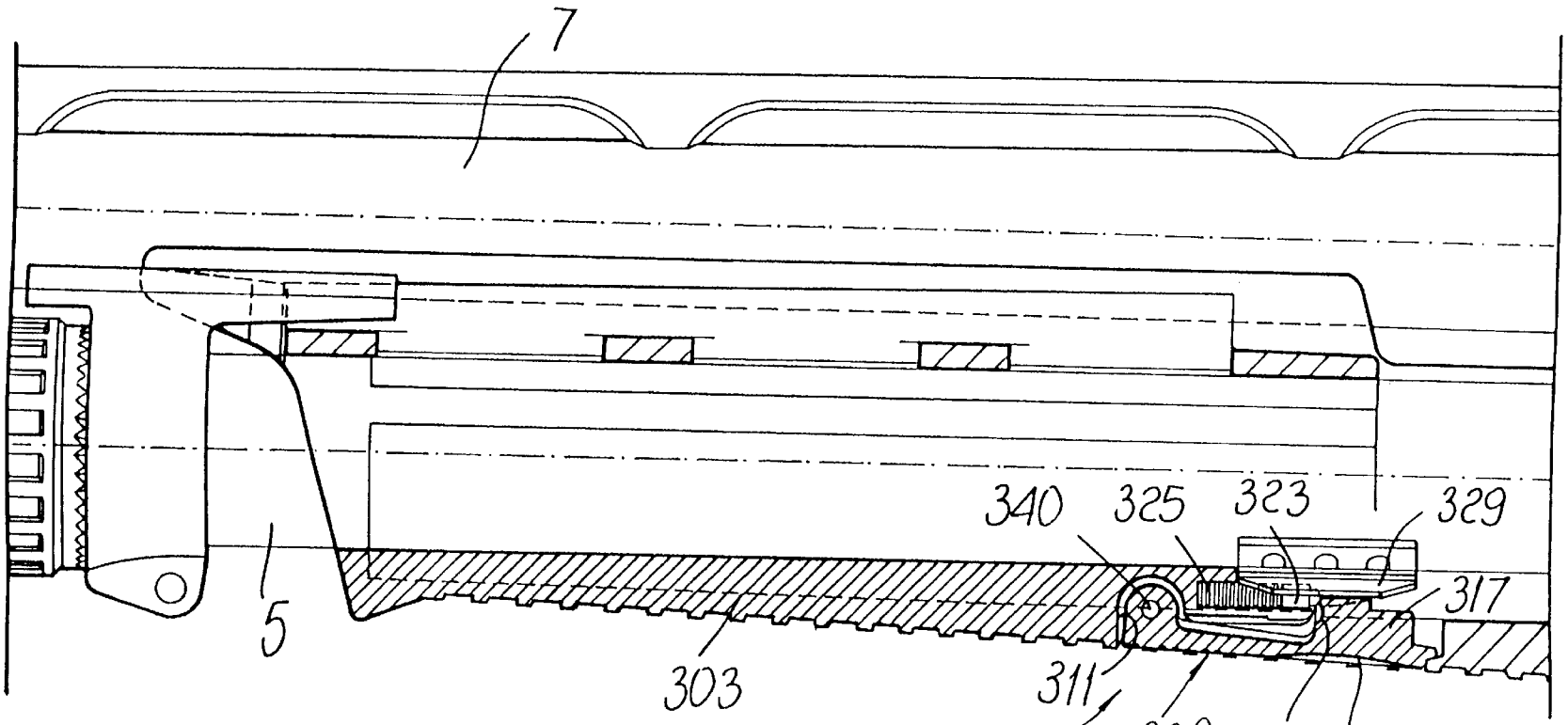
FIG. 17 is a partial longitudinal sectional view of a pump-action shotgun provided with the device according to a fourth aspect of the invention, shown in the breech-block closure position.
Figure 18:
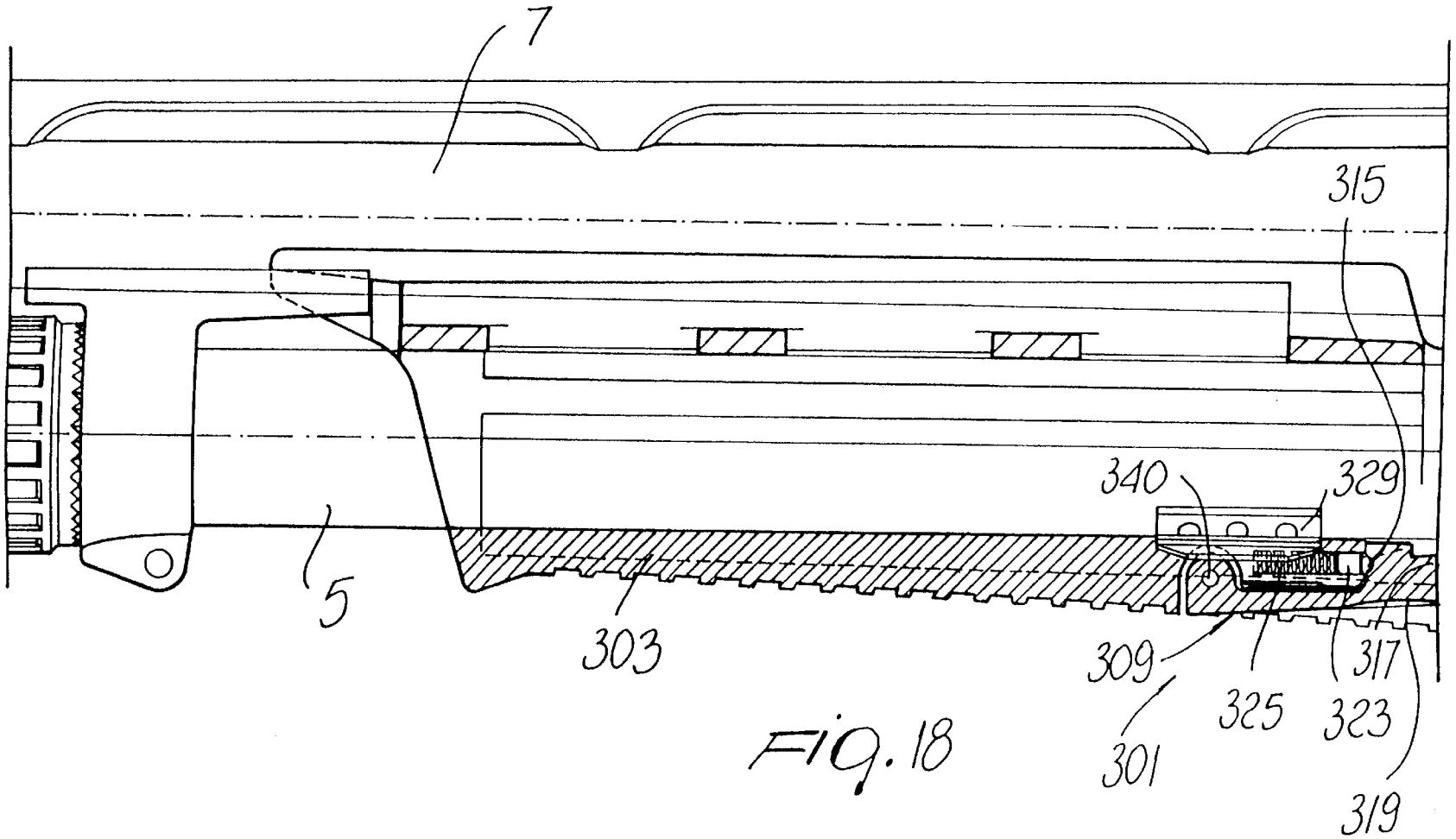
FIG. 18 is a view, similar to FIG. 17, of the cocking rod in a partially retracted position and of the device in the stroke limiting position.
Figure 19:
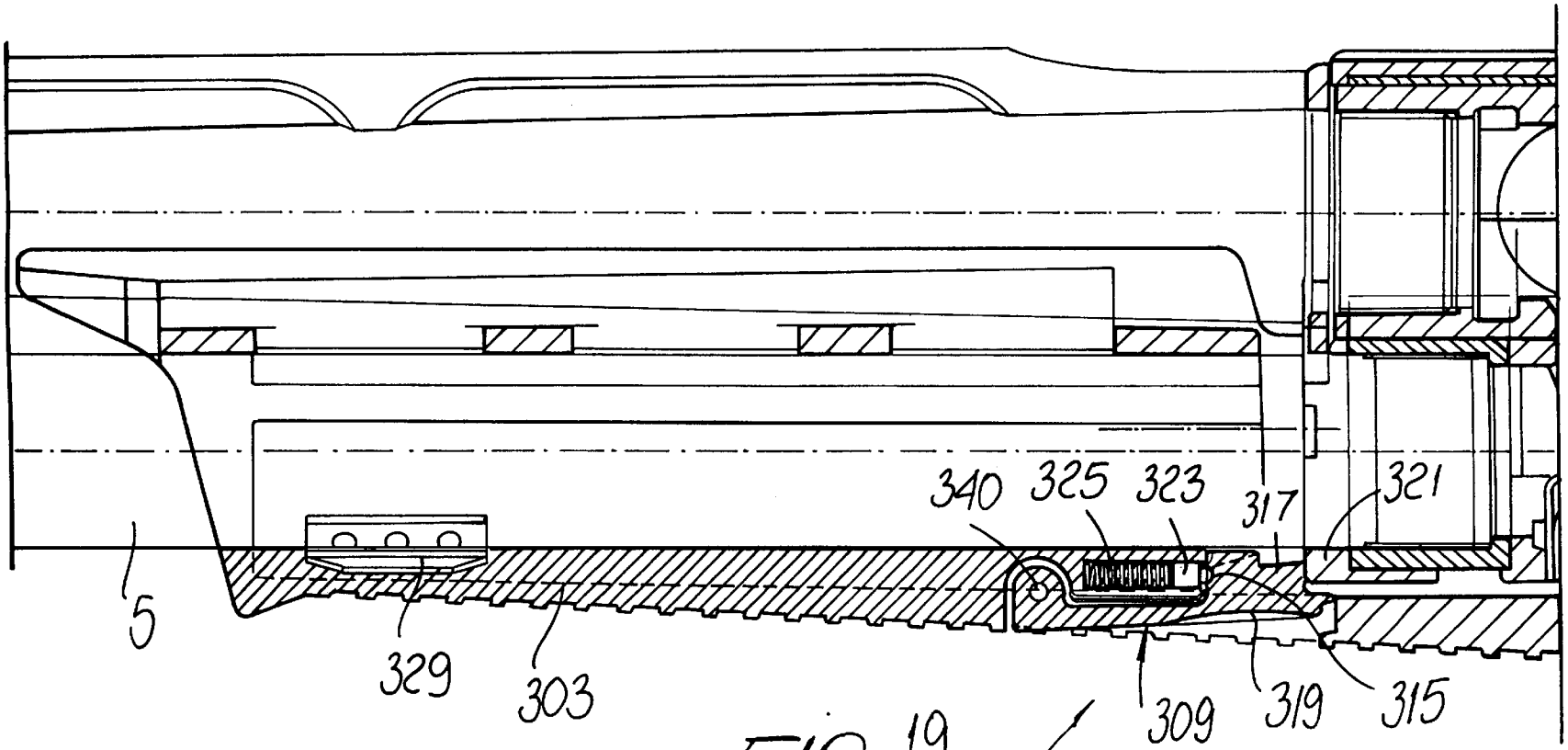
FIGS. 19 is a view, similar to FIG. 18, of the cocking rod in the rearmost position with the device in the stroke limiting position.
Figure 20:
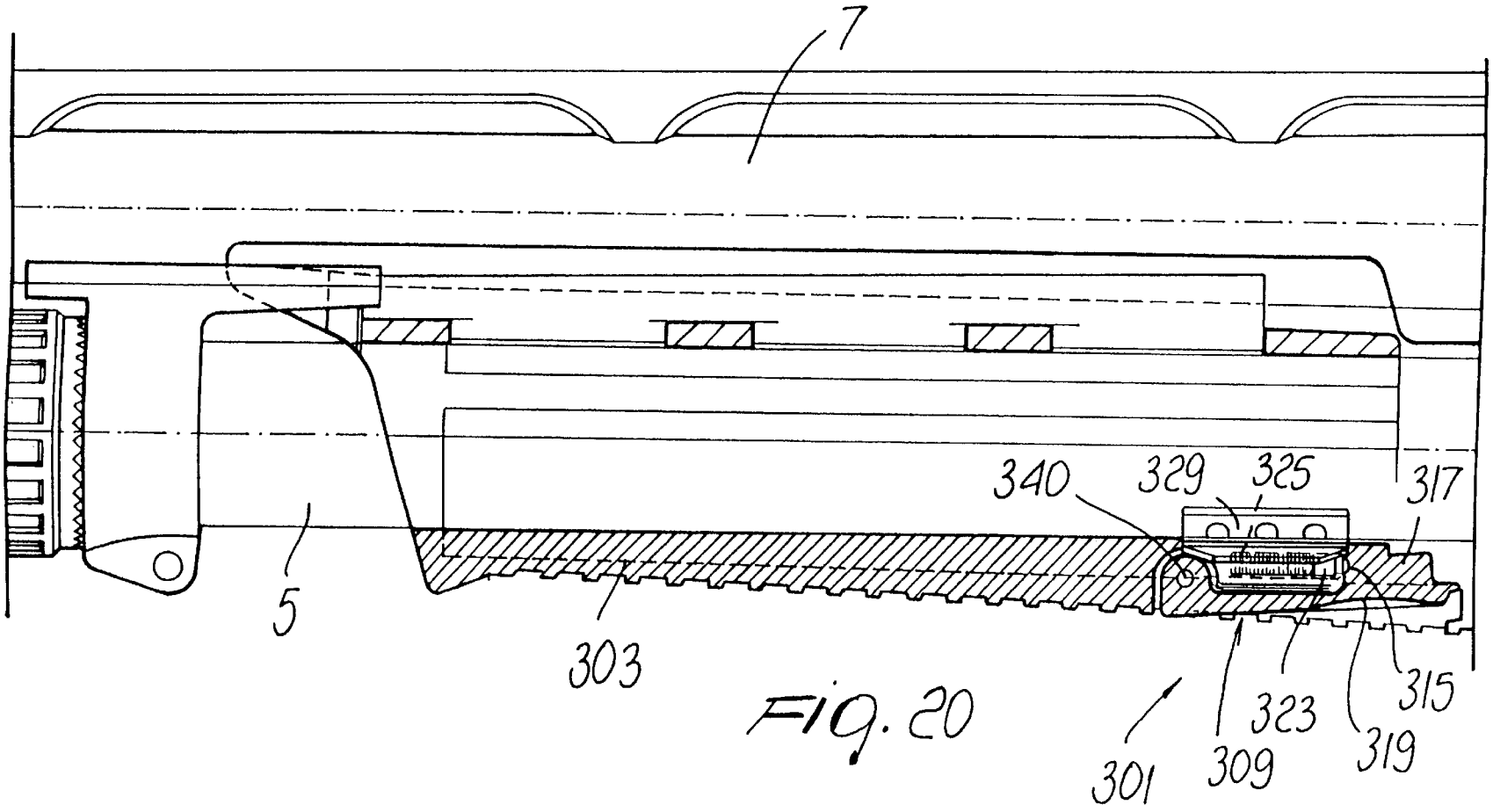
FIG. 20 is a view, similar to FIG. 19, of the cocking rod in the return stroke proximate to the breech-block closure position.
Figure 21:
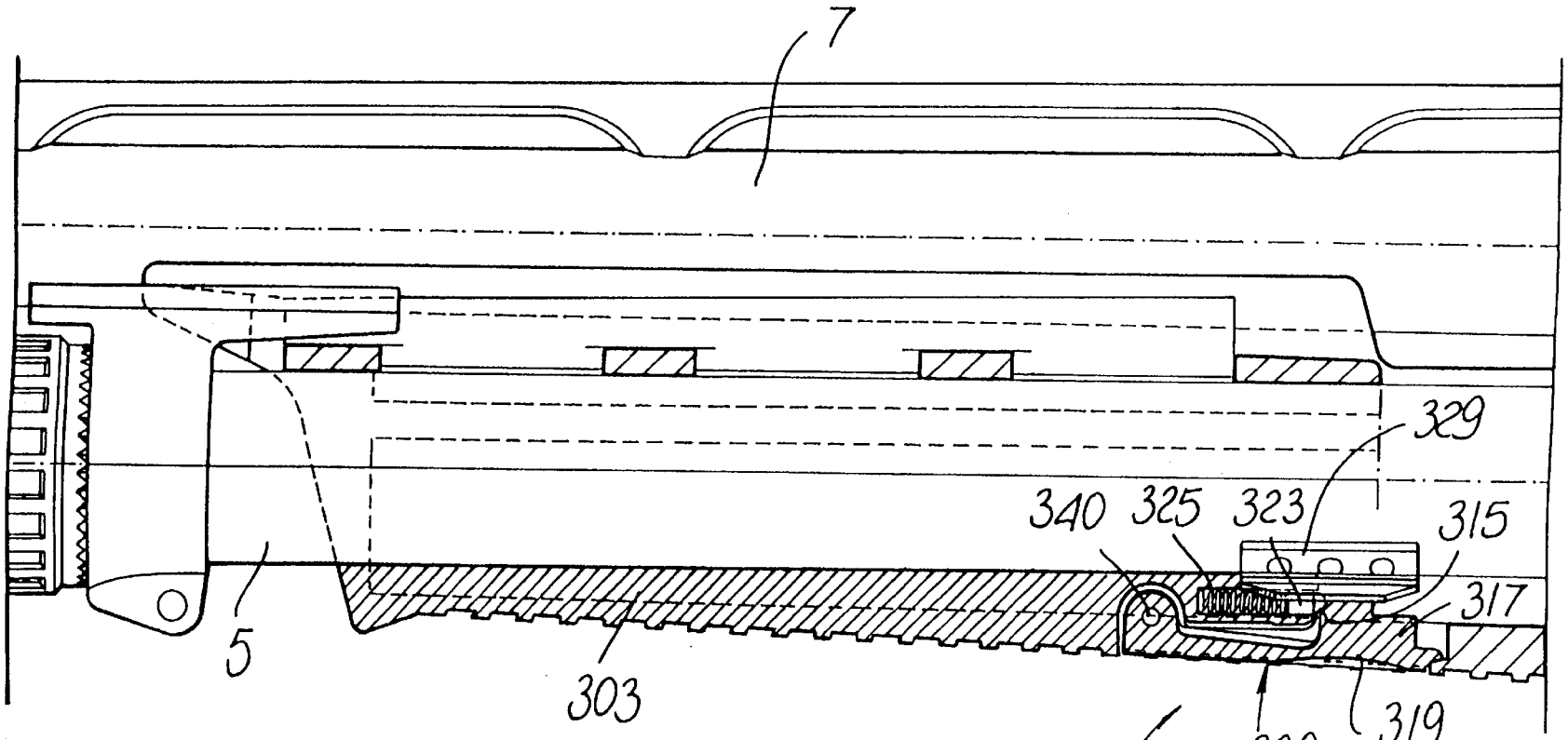
FIG. 21 is a view, similar to FIG. 20, of the cocking rod in the position that corresponds to the closure of the breech-block.
Figure 22:
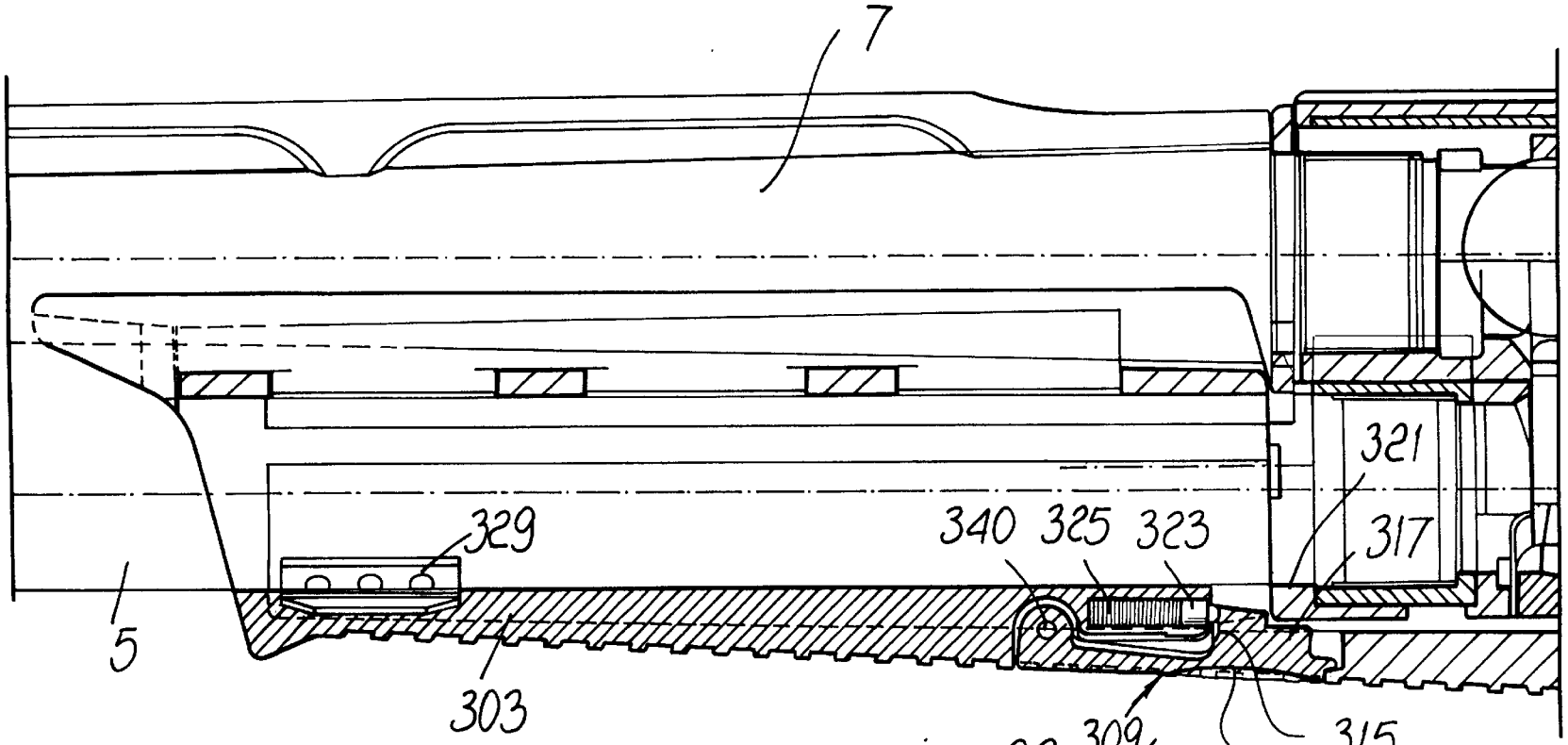
FIG. 22 is a view, similar to FIG. 21, of the cocking rod in the fully retracted position, in the breech-block opening position with the device in the position for the normal operation of the firearm.

The control device also includes a means for restoring the normal operating position of the limiter 209. The restoring means is constituted by a rod 229 which can slide longitudinally with respect to the tubular magazine 5 and has a head which is provided with a slot 241 which accommodates the pivot 240. The rod 229 has a front end which is suitable to abut against the tenon of the shotgun when the cocking rod 203 approaches the front position (FIG. 14) in the vicinity of the breech-block closure position (FIG. 15). In this position (FIG. 14), the head of the rod 229 interferes with the limiter 209. The head of the rod 229 in fact includes at least one inclined plane 231 which is suitable to cooperate with an inclined plane 233 which is formed on the limiter 209.

FIGS. 11–16 show an operating sequence which is substantially similar to the one shown in the above FIGS. 1–7.

FIGS. 17–22 illustrate a device for controlling the feeding system of pump-operated shotguns according to a fourth aspect of the invention, which is generally designated by the reference numeral 301 and can be applied to a conventional-type pump-action shotgun, which includes a cocking rod 303 which can slide coaxially on a cartridge magazine 5 which is in turn arranged below the barrel 7. The cocking rod 303 actuates one or two braces which are associated with the breech-block (and are not shown in the drawings) in a per se known manner.

The control device includes a limiter 309 which is arranged in a seat 311 formed in the cocking rod 303. The limiter 309 is constituted by a lever which is pivoted to the rod 303 by means of the pivot 340, which is rigidly coupled to the body of the shotgun. The limiter 309 also includes a button 319 which can be operated with one finger of the hand that grips the cocking rod 303, a locking seat 315 and a locking member 317 which is suitable to cooperate with a fixed abutment 321 constituted by the front surface of the frame.

The seat 315 can be engaged by a pivot or pin 323 which can slide longitudinally in contrast with a spring 325. By engaging the seat 315, the pin 323 keeps the limiter 309 in the operating position for limiting the backwards stroke of the cocking rod 303.

The control device 301 also includes a means for restoring the normal operating position of the limiter 309. The restoring means is constituted by at least one contoured blade which is fixed to the tubular magazine 5 in such a position as to interfere with the limiter 309 when the cocking rod 303 is substantially in the position that corresponds to the closure position of the breech-block.

FIGS. 16–22 show an operating sequence which is substantially similar to the one shown in the preceding FIGS. 1–7.

The materials used, as well as the dimensions, may of course be any according to the requirements and the state of the art.

What is claimed is:

1. A device for controlling the feeder system of a pump-action shotgun having a breech-block which is operatively associated with a cocking rod which is adapted to move in a backward stroke and alternatively a forward stroke between two stroke limit positions of the breech-block, a closed position and an open position, the motion of said cocking rod actuating the feeding of a cartridge from a tubular magazine to a rising block when said breech-block reaches the open position and from the rising block into a firing chamber of a barrel of said shotgun when said breech-block returns to the closed position, comprising a limiter for limiting the backward stroke of said cocking rod and for opening said breech-block, said limiter being adapted to selectively prevent said breech-block from reaching the open position.

2. The device according to claim 1, wherein said limiter has two positions: a normal operating position, in which said limiter does not interfere with the backwards stroke of said breech-block, and an activation position, in which said limiter interferes with said backwards stroke, preventing said breech-block from reaching the open stroke limit position.

3. The device according to claim 2, wherein said limiter cooperates with a restoring means which acts automatically on said limiter, pushing said limiter from said activation position to said normal operating position during the forward stroke of said locking rod.

4. The device according to claim 3, wherein said restoring means is rigidly coupled to a shotgun body and acts on said limiter when said cocking rod is proximate to, or at, the closed stroke limit position of the breech-block.

5. The device according to claim 3, wherein said restoring means comprises at least one contoured blade which is mounted to the magazine of said shotgun and comprises at least one inclined plane acting on said limiter at least at a closure position of said cocking rod corresponding to the closed stroke limit position of the breech-block.

6. The device according to claim 3, wherein said limiter is pivoted to said cocking rod by means of a pivot and in opposition to force exerted by at least one elastic member.

7. The device according to claim 6, wherein said restoring means is constituted by an additional rod which can slide longitudinally with respect to said tubular magazine and has a head which is provided with a slot which accommodates said pivot of said limiter, said additional rod having a front end adapted to abut against a shotgun tenon when the cocking rod approaches a forward one of said stroke limit positions said head of the additional rod interfering with said limiter in said forward position, said head of the rod comprising at least one inclined plane cooperating with a second inclined plane formed on said limiter.

8. The device according to claim 2, wherein said limiter has a locking member which is adapted to cooperate with a fixed abutment which is associated with a shotgun body, when said limiter is in said activation position.

9. The device according to claim 2, wherein said limiter comprises at least one locking seat which corresponds to said activation position, said locking seat cooperating with a flexible elastic member in order to keep said limiter stably in said activation position.

10. The device according to claim 2, wherein said limiter comprises two locking seats which correspond respectively to said activation position and to said normal operating position, said locking seats cooperating with a flexible elastic member in order to keep said limiter in one of said positions.

11. The device according to claim 10, wherein said limiter can slide in a transverse seat which lies substantially perpendicularly to a longitudinal direction of motion of said cocking rod and wherein said elastic member is constituted by a pin which acts in opposition to a spring and can slide in a longitudinal seat which is connected to said transverse seat.

12. The device according to claim 1, wherein said limiter is associated with said cocking rod and can be actuated manually.

13. The device according to claim 1, wherein said limiter can slide in a seat which lies substantially at right angles to a longitudinal direction of motion of said cocking rod.

* * * * *